US012708193B1

(12) United States Patent
Lenzo

(10) Patent No.: US 12,708,193 B1
(45) Date of Patent: Aug. 18, 2026

(54) BELT IMPLEMENT ATTACHMENT ASSEMBLY AND SYSTEM FOR DETACHABLY ATTACHING AN IMPLEMENT THERETO

(71) Applicant: Christopher Lenzo, Fort Mill, SC (US)

(72) Inventor: Christopher Lenzo, Fort Mill, SC (US)

( * ) Notice: Subject to any disclaimer, the term of this patent is extended or adjusted under 35 U.S.C. 154(b) by 0 days.

(21) Appl. No.: 19/467,771

(22) Filed: Feb. 2, 2026

(51) Int. Cl.
*A45F 3/14* (2006.01)
*A45F 3/00* (2006.01)
*B65D 25/20* (2006.01)

(52) U.S. Cl.
CPC ..... *A45F 3/14* (2013.01); *B65D 25/20* (2013.01); *A45F 2003/003* (2013.01); *A45F 2003/144* (2013.01)

(58) Field of Classification Search
CPC ..... A45F 3/14; A45F 2003/144; A45F 2005/006; A45F 5/021
See application file for complete search history.

(56) References Cited

U.S. PATENT DOCUMENTS 4,741,074 A * 5/1988 Budano, II ..... A45F 5/02 224/269
5,799,847 A 9/1998 Sandor
6,041,444 A 3/2000 McKinney
6,578,745 B1 6/2003 Taylor et al.
6,880,794 B1 4/2005 Kahn
7,314,153 B2 * 1/2008 Musarella ..... B25H 3/006 224/663
7,690,541 B2 4/2010 Pellegrini
8,485,406 B2 * 7/2013 Huh ..... F16B 45/023 224/904
10,495,411 B1 * 12/2019 Tedder ..... F41C 33/045
10,736,406 B2 8/2020 Hintze
10,932,552 B2 * 3/2021 Zamarron ..... A45F 5/14
11,065,756 B2 7/2021 Paxton
2002/0170933 A1 11/2002 Martin
2004/0045992 A1 * 3/2004 Dohn ..... B25H 3/006 224/268
2006/0104735 A1 5/2006 Zeiler et al.
2007/0090136 A1 * 4/2007 Stowell ..... A44B 11/005 224/163
2007/0099469 A1 5/2007 Sorensen
2007/0114255 A1 * 5/2007 Spadaccini ..... A45F 3/14 224/257

(Continued)

FOREIGN PATENT DOCUMENTS

GB 2347884 A 9/2000

*Primary Examiner* — Brian D Nash
(74) *Attorney, Agent, or Firm* — Invention To Patent Services; Alex Hobson

(57) ABSTRACT

A belt implement attachment system includes a belt implement attachment assembly configured to extend around a bucket or a person to retain one or more implement thereto in a detachably attachable fashion for quick retrieval and retaining of implements from a belt coupler component that has a catch component that rotates to and away from the belt coupler component and has a retainer loop portion for retaining a implement coupler that is affixed to the implement; whereby the implement coupler can rotate within the retainer loop portion and also rotate away from the belt coupler component via the catch component to allow easy attachment and detachment of the implement to the belt coupler component.

20 Claims, 9 Drawing Sheets

(56) References Cited

U.S. PATENT DOCUMENTS

| | | | | |
|---|---|---|---|---|
| 2009/0229292 | A1 | 9/2009 | Sweeney | |
| 2011/0036880 | A1* | 2/2011 | Lee | A45F 5/02 224/269 |
| 2011/0108588 | A1* | 5/2011 | Bar | B65H 49/36 224/162 |
| 2017/0095068 | A1* | 4/2017 | Moreau | A45F 5/021 |
| 2018/0000234 | A1 | 1/2018 | White | |
| 2019/0166984 | A1* | 6/2019 | Wall | A45F 5/021 |
| 2025/0127290 | A1 | 4/2025 | Rohrbach et al. | |

* cited by examiner

BELT IMPLEMENT ATTACHMENT ASSEMBLY AND SYSTEM FOR DETACHABLY ATTACHING AN IMPLEMENT THERETO

BACKGROUND OF THE INVENTION

Field of the Invention

The invention relates a belt implement attachment system that includes a belt implement attachment assembly configured to extend around a bucket or a person to retain one or more implements thereto in a detachably attachable fashion for quick retrieval and retaining of implements from a belt coupler component that has a catch component that rotates to and away from the belt coupler component and has a retainer loop portion for retaining a implement coupler that is affixed to the implement; whereby the implement coupler can rotate within the retainer loop portion and also rotate away from the belt coupler component via the catch component to allow easy attachment and detachment of the implement to the belt coupler component.

Background

Retainers for various implements are available but are generally only designed for a particular type of implement, such as for screwdrivers, or hammers, or wrenches, for example. Also, there are tool belts with pockets, but the tools are hard to find within the pockets and reaching into the pocket can lead to injury if the tools have sharp edges and/or there are nails, screws or other sharp or pointed objected also in the pocket. Furthermore, when wearing a tool belt, the tools can become pinched during certain movements and can poke into a person's waist or leg minimizing mobility and, in some cases, causing injury. Finally, some tool belts have specific retainers for various implements but require specific engagement of the tool with the retainer which requires the worker to stop working and focus on the orientation of the implement to enable coupling with the retainer.

SUMMARY OF THE INVENTION

The invention is directed to a belt implement attachment system that includes a belt implement attachment assembly configured to extend around a bucket or a person to retain one or more implement thereto in a detachably attachable fashion for quick retrieval and retaining of implements from a belt coupler component that has a catch component that rotates to and away from the belt coupler component and has a retainer loop portion for retaining a implement coupler that is affixed to the implement; whereby the implement coupler can rotate within the retainer loop portion and also rotate away from the belt coupler component via the catch component to allow easy attachment and detachment of the implement to the belt coupler component.

The belt implement attachment assembly is configured to extend around a retainer, such as a bucket, or around the waist of a person. The belt implement attachment assembly includes a belt that includes a buckle to change the length of the belt around a retainer to secure the belt to the retainer. The belt may be configured around a bucket, such as the bucket rim with a plurality of implements attached thereto via the belt coupler assemblies, each comprising a belt coupler component and a catch component. The belt coupler component may include retainer flanges that extend from the belt side of the belt implement coupler and configured to interface with flanges or flanges that extend around the top of a bucket. The retainer flanges may be secured between two bucket flanges.

The belt coupler component may be a rigid material or semirigid material such as a semirigid plastic to enable some deflection around a bucket or waist of a person and may be an elastic and a deformable material enabling the belt coupler component to bend to conform to the curvature of a bucket or a person's waist, such as along a radius of curvature of at least 25 cm along the belt axis or length axis of the belt. The belt coupler component may be plastic, rubber, silicone, urethane, polymer material and other rigid, semirigid, deformable and elastic material. The belt coupler component may have a belt aperture for receiving the belt therethrough. Also, the belt coupler component may be configured to slide along the length of the belt when in a straight configuration, such as when loose and not curved around a retainer. However, when the belt coupler component is bent to curve around the bucket or waist of a person, the friction between the belt coupler component and the belt may prevent sliding or movement of the belt coupler.

An exemplary belt implement attachment assembly may enable a plurality of belt coupler components to be configured on the belt, such as four or more, six or more, ten or more, twelve or more, or even twenty or more and any range between and including the values provided.

The belt coupler assembly includes a catch component that includes a tapering extension portion and a retainer loop portion for receiving an implement coupler that is configured to attach to an implement. The catch component is pivotably coupled to the belt coupler component such that it can pivot away from the implement side of the belt coupler component. The belt coupler component may have pivot flanges that include the catch component pivot for the catch component to pivot there about. The pivot flanges may extend out from the implement side of the belt coupler component and the catch component pivots may be apertures for receiving the catch component therein.

The catch component may be a wire extension, a formed elongated extension of metal that may have a circular cross-section. The catch component may extend from a first catch component pivot to a second catch component pivot and these two catch component pivots may be configured on opposing sides of the belt coupler component and may be apertures in the pivot flanges extending out from the belt coupler component. The catch component may taper from the two ends or the two pivot flanges down to a tapered end having a tapered end width between the catch component extension. The catch component may then form a retainer loop portion, a portion of the catch component that extends from the tapered end to form a loop and this loop may have a larger diameter than the tapered end width. This configuration may require the catch extension of an implement coupler to slide through the tapered end before being retained in the retainer loop portion. The catch extension may be cylindrical in shape and may have a diameter that is slightly larger than the tapered end width which may require the catch component to flex open for the catch extension of the implement coupler to slide through the tapered end and into the retainer loop portion. The catch extension may be a rigid cylindrical shaped extension from the retain catch portion which may be a disc that is rigid.

The implement coupler is coupled with an implement directly or to an implement interface component that is coupled with the implement. An implement interface component may be or couple with implement retainer which may be a sleeve, or flange or hook for retaining an implement therein.

An implement coupler includes a catch portion on the coupling end of the implement coupler and this catch portion may be disc shaped and have a larger diameter than the catch extension of the implement coupler. The catch portion may have a diameter smaller than the distance or width between the tapering portion of the catch component which enables the catch portion to be inserted into and through the tapering portion of the catch component with the catch extension extending away from the implement side of the belt coupler component to the implement. The catch portion may have a diameter that is larger than the diameter of the retainer loop portion of the catch component that secures the catch component within the retainer loop portion. Also, the catch component is configured to rotate with in the retainer loop portion to allow the implement and/or the implement interface component including an implement retainer to rotate.

The belt implement attachment assembly provides two degrees or rotational freedom of the implement or implement interface, with the pivoting of the catch component about the catch component pivots in the belt coupler component and rotation of the catch component within the retainer loop portion, which is about a retainer loop axis that is orthogonal to the catch component pivot axis.

These two rotational directions enable an implement and/or implement interface or implement retainer to rotate and move during work when the belt implement attachment assembly is configured around a person's waist. Also, this two degrees of rotation of the implement enables quick and easy insertion and removal of the implement from the belt implement attachment assembly.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
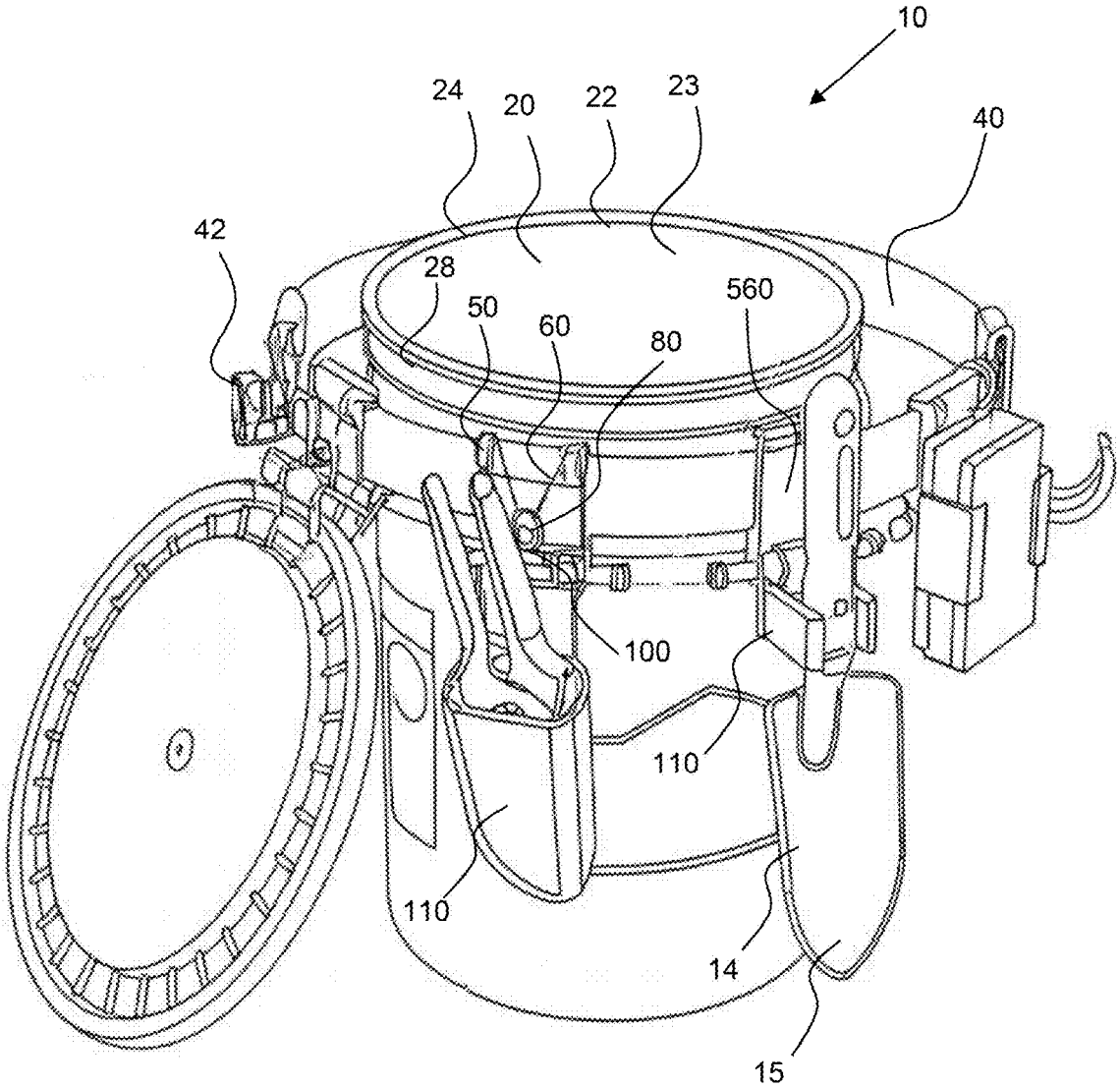
FIG. 1 shows a side perspective view of a bucket and the belt implement attachment assembly extending around the bucket rim with a plurality of implements attached thereto via the belt coupler assemblies, each comprising a belt coupler component and a catch component.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
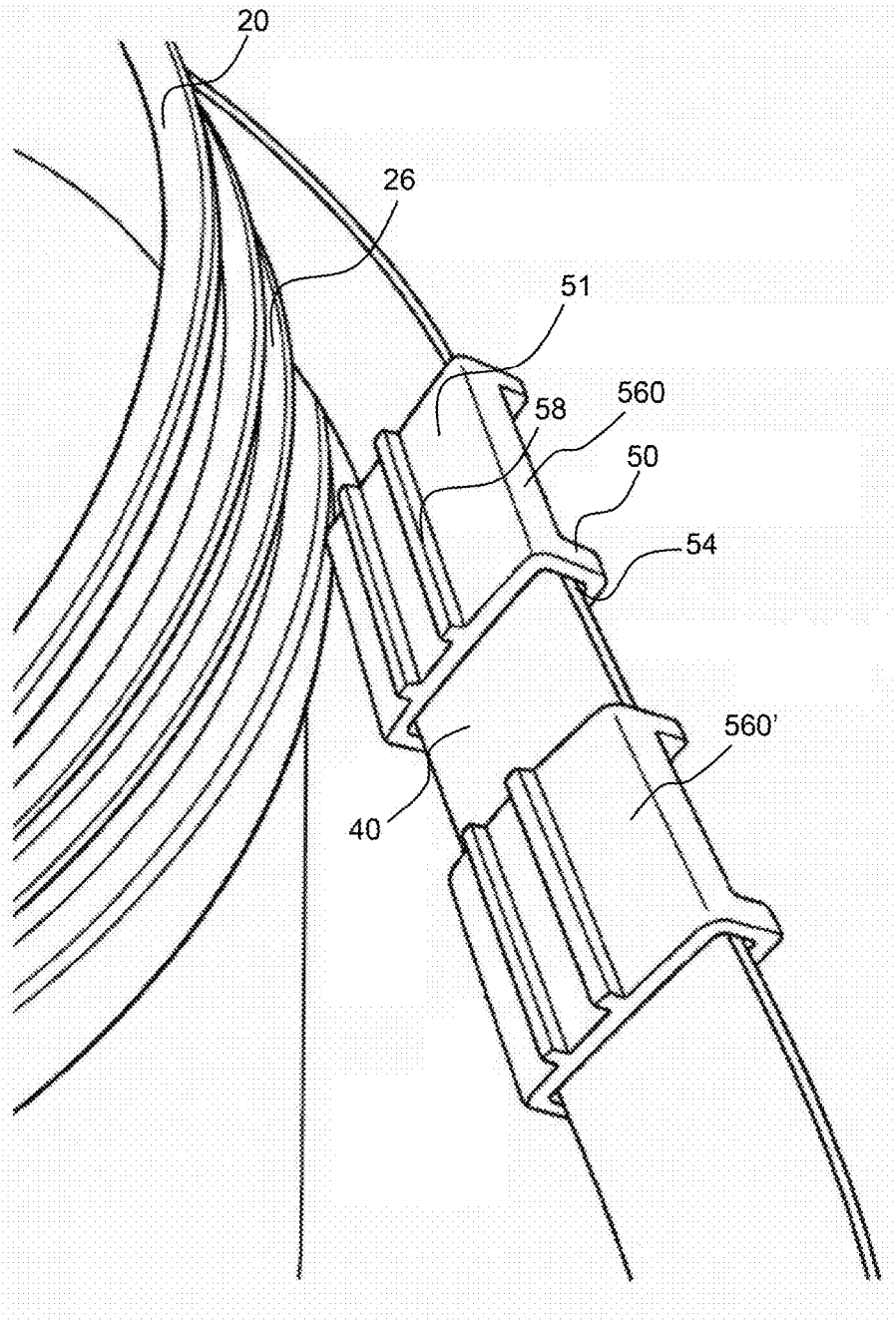
FIG. 2 shows a perspective view of bucket and an implement attachment assembly with a pair of belt coupler assembly coupled to a belt with the belt extending through the belt aperture of the belt coupler component to enable the belt coupler components to slide along the length of the belt and retainer flanges extending from the belt side of the belt coupler component to engage with flanges extending around the bucket.

As shown in FIG. 1, a bucket 20 and the belt implement attachment assembly 11 creates a belt implement attachment system 10 for enabling detachable attachment of implements thereto. The belt implement attachment assembly 11 extends around the bucket rim 24 with a plurality of implements 14 attached thereto via the belt coupler assemblies 560 that each have a belt coupler component 50 and the catch component 60. The implements may be tools 15, such as hand tools as shown. The bucket has a bucket open end 22 forming a bucket opening 23 and a bucket rim 24. A bucket may have bucket flanges that extend around the outer surface proximal to the bucket rim and these flanges may aid in retaining the belt 40 to the bucket as shown in FIG. 2. The belt implement attachment assembly may include a plurality of belt coupler assemblies that can slide around the outer perimeter 28 of the bucket. The implements may be coupled directly to the catch component via the implement coupler 80 or may be retained by an implement retainer 110 that is coupled to the implement coupler by an implement interface component 100.

As shown in FIG. 2 a belt implement attachment assembly 11 is configured with a pair of belt coupler assembly 560, 560' coupled to a belt 40 with the belt extending through the belt aperture 54 of the belt coupler component 50 to enable the belt coupler components to slide along the length of the belt and retainer flanges 58 extending from the belt side 51 of the belt coupler component to engage with bucket flange 26 extending around the bucket 20.

Figure 3:
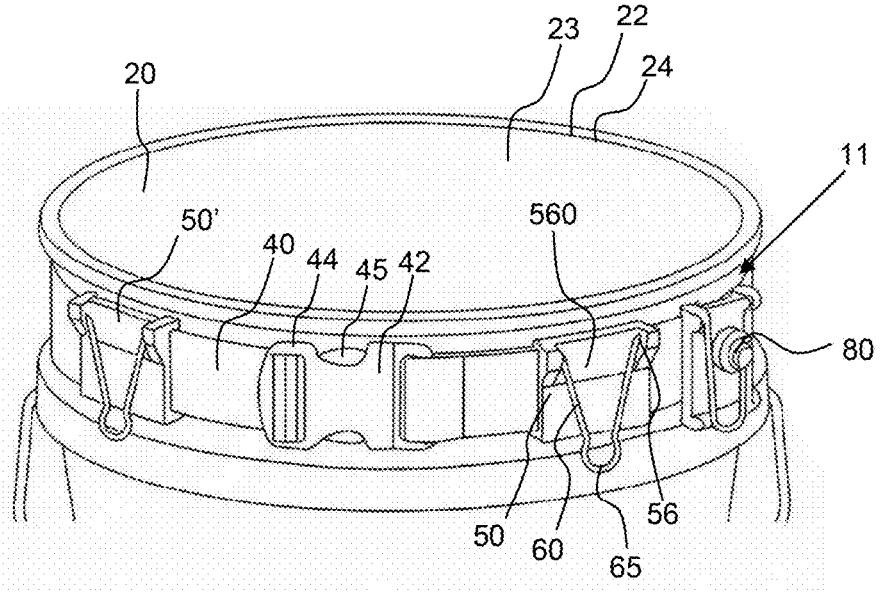
FIG. 3 shows a side perspective view of a belt implement attachment assembly extending around the top rim of the bucket, with the belt implement attachment assembly comprising a belt and buckle to secure the belt around the bucket, and a plurality of belt coupler assemblies each having a belt coupler component coupled to the belt, and each having a catch component that includes a tapering extension portion and a retainer loop portion for receiving a implement coupler that is configured to attach to an implement.

As shown in FIG. 3, a belt implement attachment assembly 11 extends around the bucket rim 24 and comprises a belt 40 and buckle 42 to secure the belt around the bucket. The belt implement attachment assembly 11 has a plurality of belt coupler assemblies 560, each having a belt coupler component 50 coupled to the belt, and a catch component 60 that includes a tapering extension portion 62 and a retainer loop portion 65 for receiving an implement coupler 80 that is configured to attach to an implement. The implement coupler 80 shown is not coupled with an implement.

Figure 4:
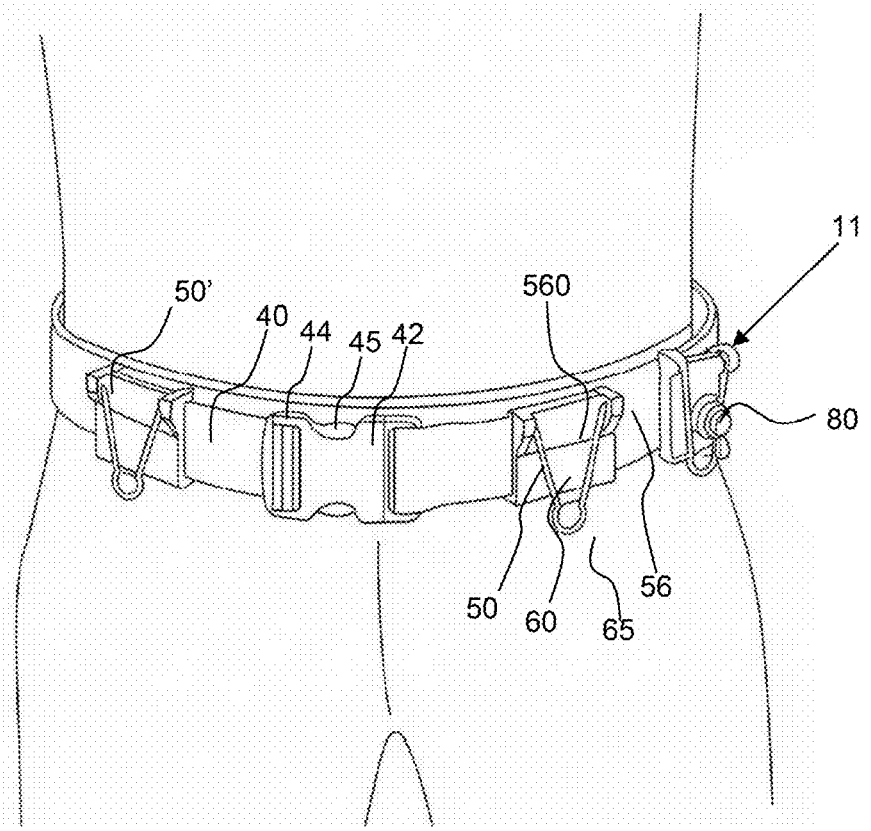
FIG. 4 shows a side perspective view of a person and the belt implement attachment assembly extending around the waist of the person, with the belt implement attachment assembly comprising a belt and buckle to secure the belt around the person's waist, and a plurality of belt coupler components coupled to the belt, each having catch component that includes a tapering extension portion and a retainer loop portion for receiving a implement coupler that is configured to attach to an implement.

As shown in FIG. 4, a belt implement attachment assembly 11 extends around the waist of a person and comprises a belt 40 and buckle 42 to secure the belt around the person's waist, and the belt may extend through belt loops of a person's pants or shorts. The belt implement attachment assembly 11 has a plurality of belt coupler assemblies 560 each having a belt coupler component 50 coupled to the belt, and a catch component 60 that includes a tapering extension portion 62 and a retainer loop portion 65 for receiving an implement coupler that is configured to attach to an implement.

Figure 5:
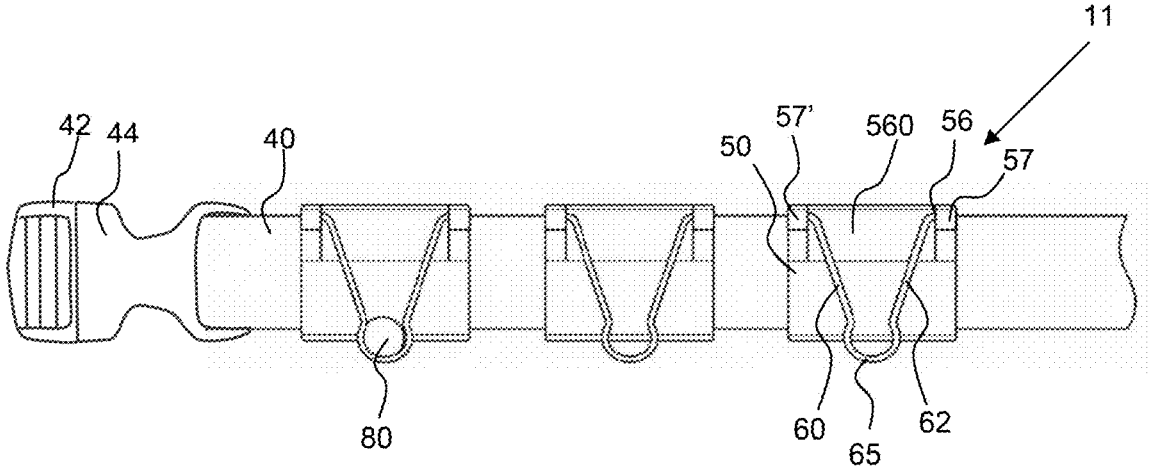
FIG. 5 show side view of a portion of the belt implement attachment system with a portion of the belt of the belt implement attachment assembly extending to a buckle receiver of a buckle, and two belt coupler assemblies slidably coupled to the belt, each comprising a belt coupler component and a catch component that is pivotably coupled to the belt coupler component.
Figure 6:
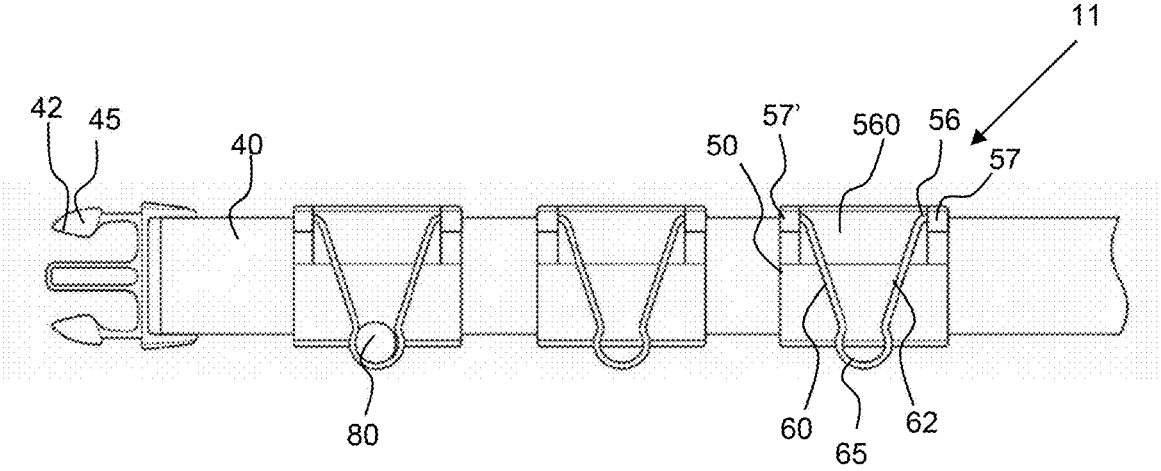
FIG. 6 show side view of a portion of the belt implement attachment system with a portion of the belt of the belt implement attachment assembly extending to a buckle insert of a buckle, and two belt coupler assemblies slidably coupled to the belt, each comprising a belt coupler component and a catch component that is pivotably coupled to the belt coupler component.

Referring now to FIGS. 5 and 6, the belt implement attachment assembly 11 includes a belt 40 having a buckle 42 that includes a buckle receiver 44 and a buckle insert 45. The belt implement attachment assembly 11 has a plurality of belt coupler assemblies 560 each having a belt coupler component 50 coupled to the belt, and a catch component 60 that includes a tapering extension portion 62 and a retainer loop portion 65 for receiving an implement coupler that is configured to attach to an implement. Each of the belt coupler assemblies 560 are slidably coupled to the belt.

Figure 7:
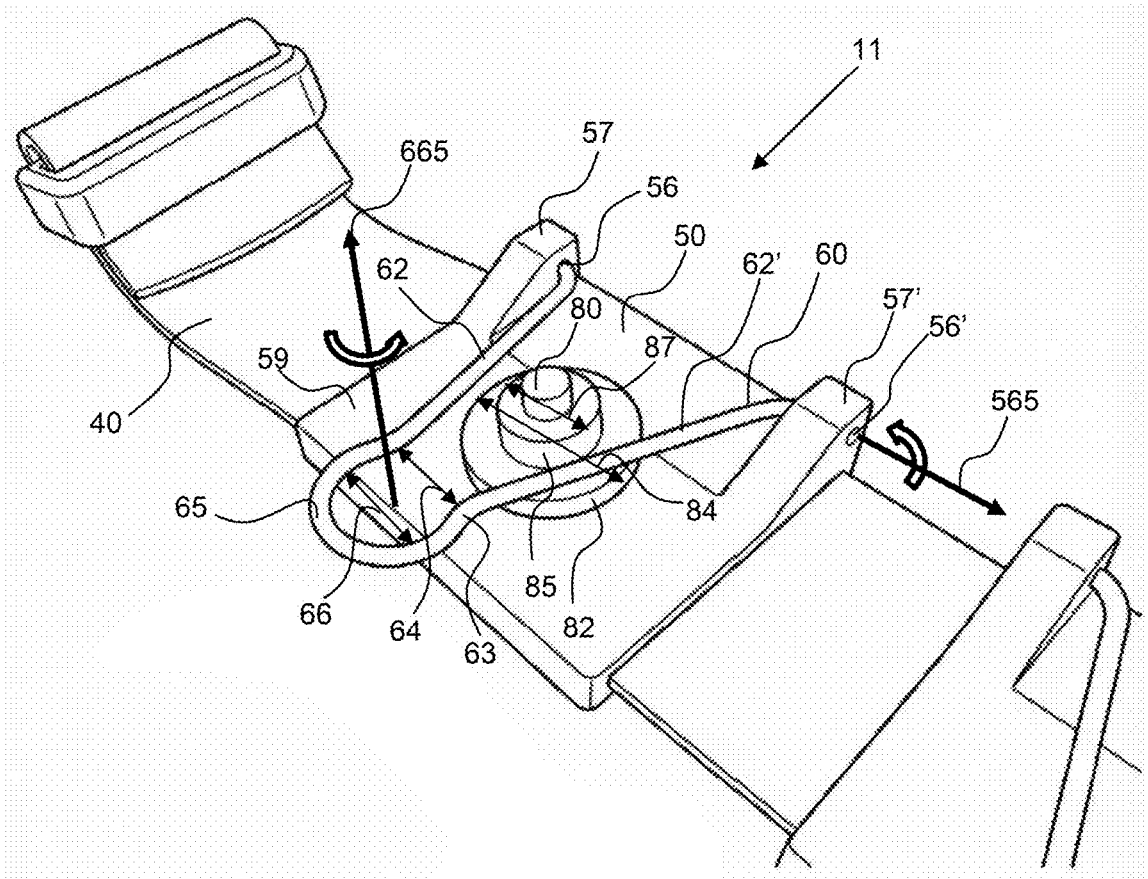
FIG. 7 shows a perspective view of a belt coupler assembly coupled to a belt and comprising a belt coupler component and a catch component that is pivotably coupled to the belt coupler component and an implement coupler configured in the tapering extension portion of the catch component configured to slide down into the retainer loop portion of the catch component to retain catch portion in the retainer loop portion with the catch extension extending through the retainer loop portion to an implement or implement interface component, such as an implement flange.

As shown in FIG. 7, a belt coupler assembly 560 is coupled to a belt 40 and comprises a belt coupler component 50 and a catch component 60 that is pivotably coupled to the belt coupler component and an implement coupler 80 configured in the tapering extension portion 62 of the catch component, configured to slide down into the retainer loop portion 65 of the catch component to retain catch portion 82 in the retainer loop portion with the catch extension 85 extending through the retainer loop portion to an implement or implement interface component, such as an implement flange. The implement coupler 80 has a catch portion 82 that has a larger dimension or catch portion diameter 84, than the tapering end width 64 or the retainer loop diameter 66, and has the catch extension 85 having a catch extension diameter 87 that may be slightly larger than the tapering end width 64 of the tapered end 63 of the tapering extension portion 62.

As shown, the catch component 60 is pivotably coupled to the belt coupler component by a pair of catch component pivots 56 that retain the catch component 60, a wire extension 67. The catch component has a tapering extension portion, wherein a width between the wire extension tapers toward the tapered end 63. The retainer loop portion 65 extends from the tapered end and the tapered end width 64 is less than the retainer loop diameter 66, wherein the catch extension 85 requires a slight deflection of the tapered end of the wire extension to force the catch extension through the tapered end and into the retainer loop portion 65. The catch component and more specifically the wire extension 67 is retained by the catch component pivots or pivots and as shown, two opposing catch component pivots 56, 56' may be configured in opposing pivot flanges 57, 57' respectively. The pivot flanges and the catch component pivots are on the implement side 59 of the belt coupler component 50.

The belt implement attachment assembly 11 provides two degrees or rotational freedom of the implement or implement interface, with the pivoting of the catch component 60 about the catch component pivots 57, 57' in the belt coupler component 50 and rotation of the implement coupler 80 within the retainer loop portion, 65 which is about a retainer loop axis 665 that is orthogonal to the catch component pivot axis 565. The rotational directions are shown in bold arc arrows around the respective axis.

Figure 8:
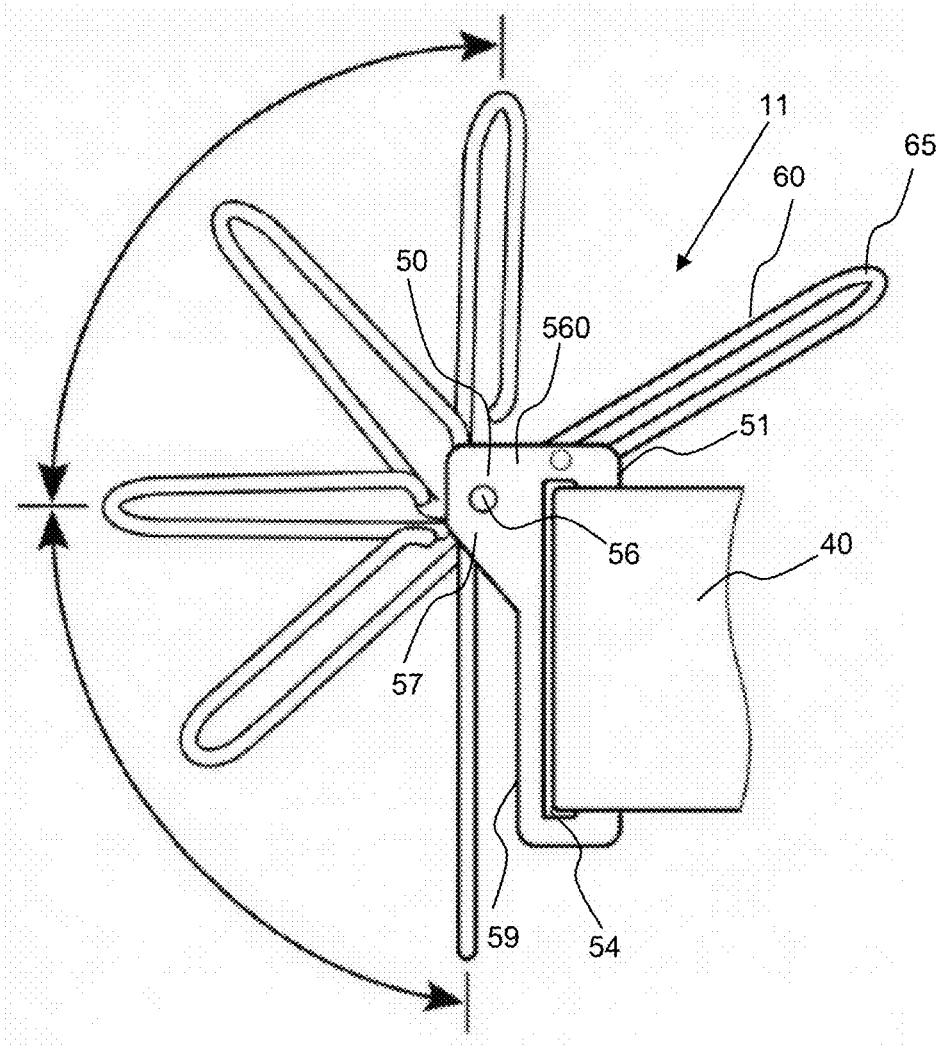
FIG. 8 shows a side view of an implement attachment assembly with a belt coupler assembly coupled to a belt and with the catch component pivoting about the belt coupler component about the catch component pivot.

As shown in FIG. 8, a belt implement attachment assembly 11 includes a belt coupler assembly 560 coupled to a belt 40 via the belt coupler component 50 having a belt aperture 54 for the belt 40 to extend therethrough. The belt coupler component has a belt side 51 and an implement side 59. The catch component 60 is coupled to the belt coupler component 50 by the catch component pivot 56 and is shown pivoting about the belt coupler component. As shown, the catch component is configured to rotate or pivot about the catch component pivot 56 and may rotate at least about 90 degrees or more, about 120 degrees or more, about 160 degrees or more, about 180 degrees or more, or even about 210 degrees (as shown) and any range between and including the pivot ranges provided. Pivoting of the catch component may enable easier detachment and attachment of an implement thereto and may provide a greater degree of freedom and range of motion during work, wherein the implement is not rigidly coupled to the belt and can flex as someone bend or kneels while wearing the belt implement attachment assembly 11.

Figure 9:
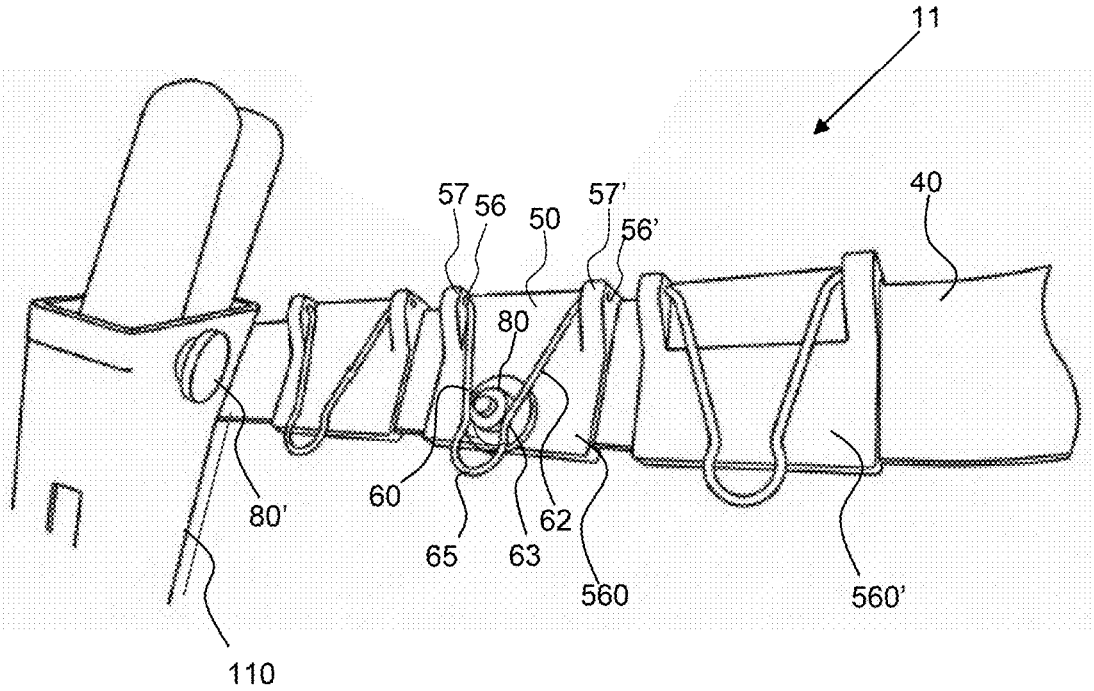
FIG. 9 shows a side perspective view of an implement attachment assembly with a plurality of belt coupler assemblies coupled to a belt and with an implement configured in an implement interface component that is coupled to the belt via the catch component that is pivotably coupled to the belt coupler component.

As shown in FIG. 9, the belt implement attachment assembly 11 has a plurality of belt coupler assemblies 560 coupled to a belt 40. As shown, an implement coupler 80' coupled with an implement 16 has a catch portion 82 and a catch extension 85, wherein the catch portion is disc shaped and has a larger diameter than the diameter of the cylindrical catch extension. The catch portion 82 is configured to extend through the tapering extension portion 62 and slide down along the implement side 59 of the belt coupler component 50 into the retainer loop portion 65. The implement coupler is configured to rotate within the retainer loop portion 65 and the catch component is configured to pivot about the catch component pivots.

Figure 10:
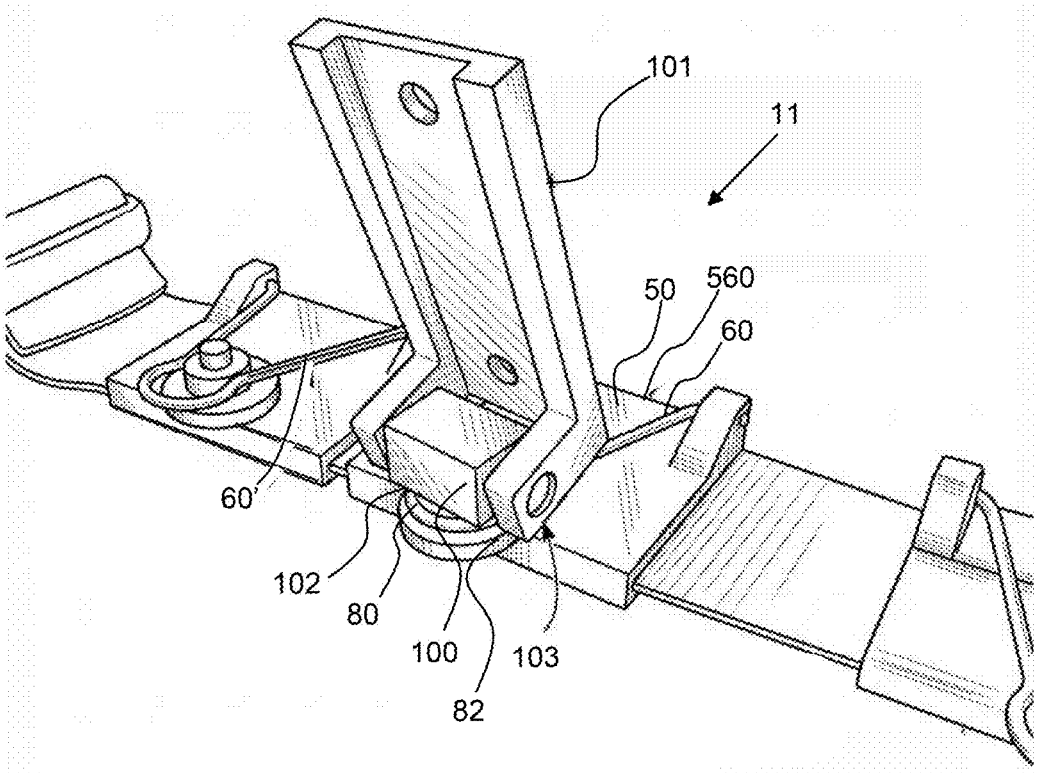
FIG. 10 shows a side perspective view of an implement attachment assembly with a plurality of belt coupler assemblies coupled to a belt and with a an implement interface component comprising an implement flange that is pivotably coupled to the belt via the implement interface pivot that is coupled to the implement coupler retained in the catch component that is pivotably coupled to the belt coupler component.

As shown in FIG. 10, a belt implement attachment assembly 11 is configured with a plurality of belt coupler assemblies 560 coupled to a belt 40 and with an implement interface component 100 comprising an implement flange 101 that is pivotably coupled to the belt via the implement interface pivot 103 that is coupled to the implement coupler 80 by the catch component 60, that is pivotably coupled to the belt coupler component 50. The implement interface coupled end 102 is coupled to the implement coupler 80, such as the catch attached end 89, shown in FIG. 11.

Figure 11:
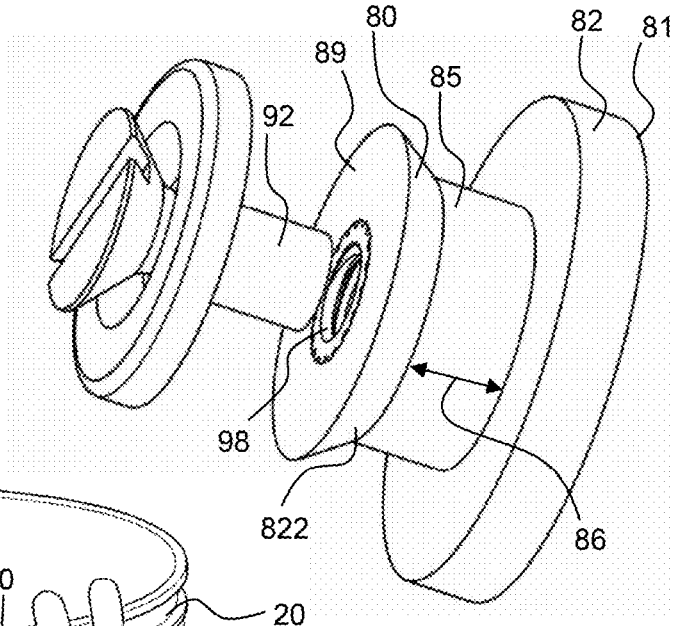
FIG. 11 shows a side perspective view of an implement coupler and an implement fastener configured to fasten the implement coupler to an implement or to an implement interface component.

As shown in FIG. 11, an implement coupler 80 includes a catch portion 82 on a coupling end 81 of the implement coupler, which may be a disc extension or flange, and a catch extension 85 extending a catch extension length 86 from the catch portion and configured to extend through the retainer loop portion to couple with an implement or to an implement interface component. The coupler extension 85 extends to the catch attached end 89, attached or coupled with an implement. An implement fastener 92 is configured to fasten the implement coupler 80 such as to the implement fastener receiver 98 and also attach to an implement or to an implement interface component. The catch portion 82 has a catch flange 822 that is configured on one side of the retainer loop portion with the implement or implement interface component. The catch flange tapers toward the catch extension 85 and may aid in easy insertion sliding of the implement coupler 80 into the catch component to the retain loop portion.

Figure 12:
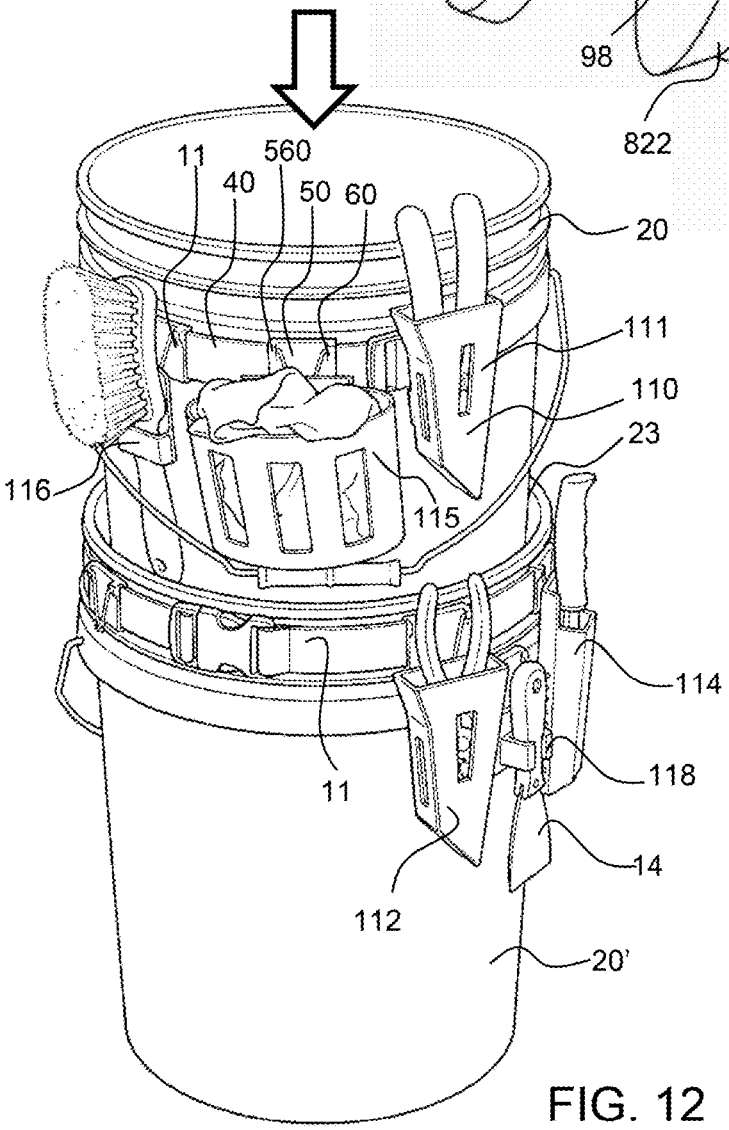
FIG. 12 shows a side perspective view of a first bucket being stacked inside a second bucket, and the belt implement attachment assembly extending around both of the buckets, around the rim, with a plurality of implements attached thereto via the belt coupler assemblies, each comprising a belt coupler component and a catch component.
Figure 12:
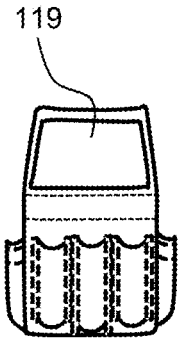

As shown in FIG. 12, a first bucket 20 is being stacked inside a second bucket 20', and each bucket has a belt implement attachment assembly 11, 11' respectively, extending around the rim. Each of the belt implement attachment assemblies have a plurality of implements 14 attached thereto via the belt coupler assemblies 560, each comprising a belt coupler component 50 and a catch component 60 that enables pivoting of the catch component and implement attached thereto away from the bucket to allow the first bucket to slide down into the second bucket. The belt implement attachment assemblies have a plurality of different types of implement retainer 110 for retaining different types of implements, wherein the implement retainers include a sleeve 112, and a tapering sleeve 111, a pocket 114, a bin retainer 115, a loop retainer 116 and a clip retainer 118. The sleeves and pockets form an enclosure for an implement or portion thereof to slide down into the sleeve or pocket. The sleeve may be a tapering sleeve to more securely retain certain types of implements. A loop retainer forms a loop and an implement or portion of an implement, such as an elongated portion, a handle or screw driver extension, may be inserted into the loop to retain the implement to the implement retainer. A clip retainer has a retainer portion that flexes open to enable snapping an implement or portion of an implement therein, such as a handle of an implement as shown. A bin retainer 115 forms an open enclosure having an open top for retaining irregularly shaped articles, such as a towel of loose items, such as nuts, bolts, etc. As shown, next to the bucket, an implement retainer may be a multi-component retainer 119 having a plurality of implement retainer types, such as a plurality of retainer sleeves or pockets or loops.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention covers the modifications, combinations and variations of this invention provided they come within the scope of the appended claims and their equivalents.

What is claimed is:

1. A belt implement attachment assembly comprising:

a) a belt;

b) a belt coupler component comprising:

i) a belt aperture;

wherein the belt extends through the belt aperture to couple the belt to the belt coupler component;

wherein the belt coupler component is slidably engaged with the belt;

wherein the belt coupler is a flexible material that can extend along a radius of curvature of at least 25 cm;

ii) a catch component pivot;

c) a catch component that is pivotably coupled to the belt coupler component via the catch component pivot, said catch component comprising:

i) a tapering extension portion that tapers to a tapered end from the catch component pivot;

ii) a retainer loop portion on the tapered end of the tapering extension portion;

wherein a width of the tapered end is smaller than a diameter of the retainer loop portion;

d) an implement coupler configured to couple to an implement and comprising:
i) a catch portion on a coupling end;
ii) a catch extension extending from the catch portion and configured to extend through the catch component to an implement;
wherein the implement coupler is configured to rotationally couple to the retainer loop portion of the catch component;
whereby in use with an implement detachably attached to the belt implement attachment assembly, the catch portion is configured on one side of the retainer loop portion and the catch extension extends through the retainer loop portion to said implement.

2. The belt implement attachment assembly of claim 1, wherein the belt further includes a buckle to adjust a length of said belt.

3. The belt implement attachment assembly of claim 1, wherein the belt coupler component further comprises retainer flanges on a belt side of the belt coupler component that are configured to couple with bucket flanges extending around an outside surface of a bucket.

4. The belt implement attachment assembly of claim 1, wherein the belt coupler is an elastic material.

5. The belt implement attachment assembly of claim 1, wherein the catch component is a wire.

6. The belt implement attachment assembly of claim 1, wherein the belt coupler component further comprises a first pivot flange and a second pivot flange and wherein a first catch component pivot is configured in the first pivot flange, and wherein a second catch component pivot is configured in the second pivot flange.

7. The belt implement attachment assembly of claim 6, wherein the catch component is a wire having a first end retained in the first catch component pivot and a second end retained in the second catch component pivot.

8. The belt implement attachment assembly of claim 6, wherein the first catch component pivot is an aperture in the first pivot flange and the second catch component pivot is an aperture in the second pivot flange.

9. The belt implement attachment assembly of claim 8, wherein the first pivot flange is configured on a first side of the belt coupler component and the second pivot flange is configured on a second side of the belt coupler component.

10. The belt implement attachment assembly of claim 8, wherein the tapering extension portion of the catch component extends from the first pivot flange and second pivot flange to the tapered end.

11. The belt implement attachment assembly of claim 1, wherein the implement coupler comprises a catch attached end.

12. The belt implement attachment assembly of claim 1, wherein the implement coupler comprises an implement fastener receiver in the catch attached end.

13. The belt implement attachment assembly of claim 1, wherein the implement fastener receiver comprises threads.

14. The belt implement attachment assembly of claim 1, wherein the catch portion of the implement coupler is a disc.

15. The belt implement attachment assembly of claim 14, wherein the catch extension is a cylinder and wherein the catch portion has a diameter that is at least 15% greater than a diameter of the catch extension.

16. The belt implement attachment assembly of claim 1, further comprising an implement interface component that is configured between the implement coupler and an implement.

17. The belt implement attachment assembly of claim 1, wherein the implement interface component comprises an implement sleeve configured to receive an implement therein.

18. The belt implement attachment assembly of claim 1, wherein the implement interface comprises an implement flange configured for attachment to an implement.

19. The belt implement attachment assembly of claim 1, wherein the implement coupler is configured on the implement interface component.

20. A belt implement attachment assembly comprising:
a) a belt and a buckle thereon to buckle the belt in a belt loop and to adjust a length of said belt in said belt loop;
b) a belt coupler component comprising:
i) a belt aperture;
wherein the belt extends through the belt aperture to couple the belt to the belt coupler component;
wherein the belt coupler component is slidably engaged with the belt;
wherein the belt coupler is a flexible material that can extend along a radius of curvature of at least 25 cm;
ii) retainer flanges on a belt side of the belt coupler component and configured to couple with bucket flanges extending around an outside surface of a bucket;
wherein the belt coupler is an elastic material;
iii) a first pivot flange comprising a first catch component pivot; and
iv) a second pivot flange comprising a second catch component pivot; wherein both the first pivot flange and second pivot flange extend from the belt side of the belt coupler component;
wherein the first pivot flange is configured on a first side of the belt coupler component and the second pivot flange is configured on a second side of the belt coupler component; and
wherein the first catch component pivot is an aperture in the first pivot flange and the second catch component pivot is an aperture in the second pivot flange;
c) a catch component that is coupled to the belt coupler component via the first and second catch component pivots, said catch component comprising:
i) a tapering extension portion that tapers to a tapered end from the catch component pivot;
ii) a retainer loop portion on the tapered end of the tapering extension portion;
wherein a width of the tapered end is smaller than a diameter of the retainer loop portion;
wherein the catch component is a wire having a first end retained in the first catch component pivot and a second end retained in the second catch component pivot;
wherein the tapering extension portion of the catch component extends from the first pivot flange and second pivot flange to the tapered end;
d) an implement coupler configured to couple to an implement and comprising:
i) a catch portion on a coupling end;
ii) a catch extension extending from the catch portion and configured to extend through the catch component to an implement;
whereby in use with an implement detachably attached to the belt implement attachment assembly, the catch portion is configured on one side of the retainer loop portion and the catch extension extends through the retainer loop portion to said implement.

* * * * *